United States Patent [19]

Bajusz

[11] 4,168,521

[45] Sep. 18, 1979

[54] WRITING IMPLEMENT WITH SELF-CONTAINED ILLUMINATION

[76] Inventor: Harold F. Bajusz, 379 Innes Rd., Woodridge, N.J. 07057

[21] Appl. No.: 891,153

[22] Filed: Mar. 28, 1978

[51] Int. Cl.[2] ..... B43K 29/10

[52] U.S. Cl. ..... 362/118; 362/155

[58] Field of Search ..... 362/118–120, 362/155

[56] References Cited

U.S. PATENT DOCUMENTS

| | | | |
|---|---|---|---|
| 1,298,384 | 3/1919 | Perrin . | |
| 1,310,476 | 7/1919 | Hart . | |
| 1,509,719 | 9/1924 | Devine . | |
| 1,610,006 | 12/1926 | Haller . | |
| 1,987,158 | 1/1935 | Quaglia . | |
| 2,607,883 | 8/1952 | Berkowitz | 362/118 |
| 3,185,832 | 5/1965 | Nagamori | 362/120 |
| 3,529,145 | 9/1970 | Siemss . | |
| 3,604,917 | 9/1971 | Schmidt | 362/118 |
| 4,016,414 | 4/1977 | Browning et al. | 362/118 |

FOREIGN PATENT DOCUMENTS

| | | | |
|---|---|---|---|
| 1092808 | 11/1960 | Fed. Rep. of Germany | 362/118 |
| 628852 | 11/1961 | Italy | 362/118 |

*Primary Examiner*—Peter A. Nelson

*Attorney, Agent, or Firm*—Finnegan, Henderson, Farabow & Garrett

[57] ABSTRACT

Disclosed is a writing implement with self-contained illumination including a barrel comprised of first and second electrically conductive sections insulated one from the other by an annular band. One section carries a lens, a writing point and a lamp, coaxially of the barrel with the lamp lying in electrical contact with the one section. The barrel also defines a battery compartment. A cap is formed of electrically conductive material and, when the writing implement is not in use, closes over the writing point about the first section. When the writing implement is to be used and illumination is not needed, the cap is disposed about the first section at the opposite end of the barrel and retained. Should illumination be necessary, the cap is pushed beyond the insulating band to electrically connect the two sections and complete an electrical circuit to the lamp to energize the lamp and illuminate the area surrounding the writing point through the lens.

12 Claims, 6 Drawing Figures

WRITING IMPLEMENT WITH SELF-CONTAINED ILLUMINATION

BACKGROUND OF THE INVENTION

The present invention relates to a writing implement and particularly to a writing implement with self-contained illumination for selective illumination of the area surrounding the writing point.

Many writing implements with self-contained illumination have been proposed and constructed in the past. For example, in U.S. Pat. No. 1,298,384, there is disclosed a writing implement comprised of a pen barrel disposed in side-by-side relation with batteries in electrical contact with a bulb located at the writing end of the implement. Both the barrel, batteries and bulbs are disposed in a cylindrical housing. The lamp is illuminated by locating the cap on the end of the implement such that a band carried internally of the cap electrically connects a pair of contacts carried by the housing. Because the lamp is located to one side of the pen point, the illumination is such as to provide shadows in front of the pen point. Also, accurate location of the cap on the housing is necessary to electrically connect and maintain connection between the band and the contacts. Furthermore, the side-by-side relation of the pen barrel and batteries requires a housing which is of substantial thickness and consequently the writing implement is not particularly well adapted or facile for its intended purpose.

In U.S. Pat. No. 1,310,476, there is provided a writing implement having a lamp disposed behind an annular lens through which a writing implement is received. The body of the implement carries a battery and the lamp is energized by means of a switch which includes a slot and a shaped bar in the cap. While this illuminated writing implement is much thinner than the previously described implement, it does require manipulation of a switch to provide the illumination as well as fabrication of a number of switch parts which increases the cost of the implement.

U.S. Pat. No. 1,610,006 also discloses an illuminated writing implement which requires the cap to be screwed down upon the end of the barrel opposite from the writing tip in order to complete an electrical circuit to a lamp which projects laterally from a side of the barrel. Obviously, the lamp of this pen interferes with the use of the pen and likewise the illumination by the lamp casts undesirable shadows on the area adjacent the tip when writing. Other writing implements with self-contained illuminating devices such as described and illustrated in U.S. Pat. Nos. 1,509,719 and 1,987,158 have similar shortcomings and objections.

SUMMARY OF THE INVENTION

The present invention provides a novel and improved writing implement with self-contained illumination which minimizes or eliminates the above discussed and other shortcomings and objections of prior writing implements with self-contained illuminating devices and provides various advantages in construction, use and result in comparison with such prior writing implements with self-contained illuminating devices. Particularly, the present invention provides a coaxial alignment of the writing point, lens and lamp to provide a relatively thin writing implement wherein illumination, when writing, is afforded all areas surrounding the writing point. This is provided in a relatively inexpensive and simple construction yet in one which facilitates switching the lamp between on and off conditions and prevents inadvertent energization of the lamp. Further, the foregoing is provided in an aesthetically pleasing implement.

Accordingly, it is a primary object of the present invention to provide a novel and improved writing implement with self-contained illumination which is simple in construction, inexpensive to fabricate and readily and easily utilized.

It is another object of the present invention to provide a novel and improved writing implement with self-contained illumination wherein the light from the lamp within the pen is transmitted substantially concentrically about the writing device to illuminate substantially the entirety of the area surrounding the writing point.

It is still another object of the present invention to provide a novel and improved writing implement with self-contained illumination wherein inadvertent illumination of the lamp is minimized or avoided with consequent extension of the life of the battery.

Additional objects and advantages of the invention will be set forth in part in the description which follows and in part will be obvious from the description, or may be learned by practise of the invention. The objects and advantages of the invention may be realized and attained by means of the instrumentalities and combinations particularly pointed out in the appended claims.

To achieve the foregoing objects and in accordance with the purpose of the invention, as embodied and broadly described herein, a writing implement with self-contained illumination according to the present invention comprises an elongated barrel having first and second tubular sections formed of electrically conductive material and axially spaced one from the other, a lens coaxially carried by the barrel at one end thereof, writing mean carried by the lens substantially coaxially therewith, means carried by the barrel electrically insulating the sections one from the other, means in the barrel defining a compartment for a battery, a lamp carried by the barrel directly coaxially behind the lens and in electrical contact with the first tubular section, the lamp having a contact for electrical connection with the terminal of the battery, means carried by the barrel for electrically connecting the other terminal of the barrel and the second section, and a cap formed of an electrically conductive material and receivable over the end of the barrel remote from the writing means to electrically connect the sections one to the other and thereby complete an electrical circuit to energize the lamp. In a preferred form of the present invention, the writing means is wholly supported by the lens with the lens concentrically surrounding the writing means to enable light to pass through the lens for illumination of substantially the entirety of the area surrounding the writing means. Also, the insulating means forms part of the structure of the barrel and includes a tubular member telescopically connected with the first and second sections, the tubular member including an annular band of insulating material electrically insulates the sections one from the other.

Also, and in a preferred form of the present invention, the cap is coated externally with an electrical insulating material to prevent inadvertent electrical connection between the first and second sections of the barrel when the writing implement is closed by the cap.

The accompanying drawings, which are incorporated in and constitute a part of this specification illustrate an embodiment of the present invention and together with the description serve to explain the principles of the invention.

DESCRIPTION OF THE PREFERRED EMBODIMENT

Reference will now be made in detail to the present preferred embodiment of the invention, an example of which is illustrated in the accompanying drawings.

Figure 1:
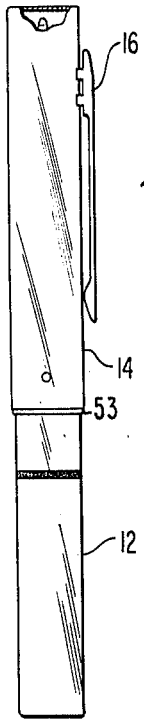
FIG. 1 is an elevational view of a writing instrument with self-contained illumination constructed in accordance with the present invention and with a fragmentary portion of the cap enclosing the end of the barrel containing the writing device broken out and in cross section.
Figure 2:
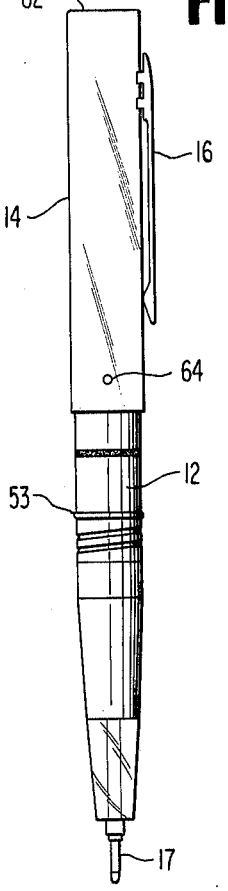
FIG. 2 is a view similar to FIG. 1 with the cap disposed on the opposite end of the barrel and illustrating the position of the cap relative to the barrel when illumination is not needed.

The preferred embodiment of the writing implement with self-contained illumination is illustrated in FIG. 1 and is represented generally by the numeral 10. The writing implement 10 includes a barrel 12 and a cap 14, a clip 16 being secured to the cap 14 for releasably securing the writing implement, in a conventional manner, to the pocket of the individual carrying the implement. When cap 14 is removed from the end of the barrel 12 and placed on its rear end, as illustrated in FIG. 2, it will be seen that barrel 12 includes a writing device 17 which, in the illustrated form of the invention, constitutes a ball point pen.

Figure 4:
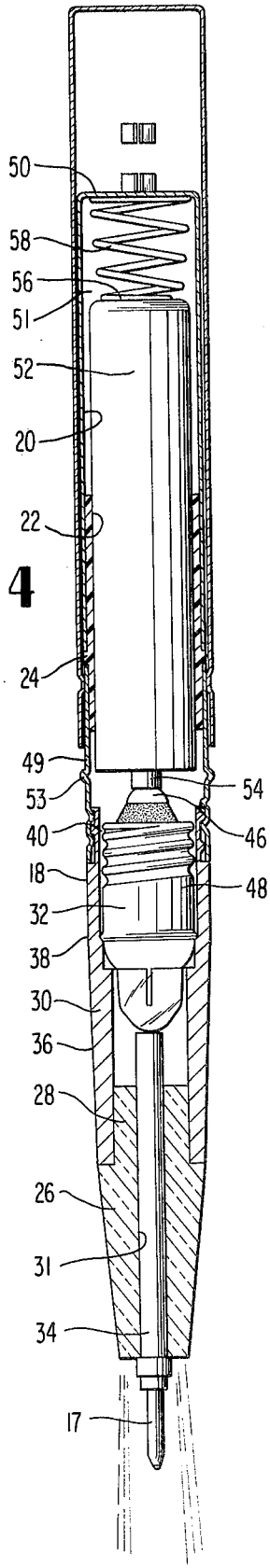
FIG. 4 is an enlarged vertical cross-sectional view of the writing implement with self-contained illumination taken generally about on line 4—4 of FIG. 3.
Figure 6:
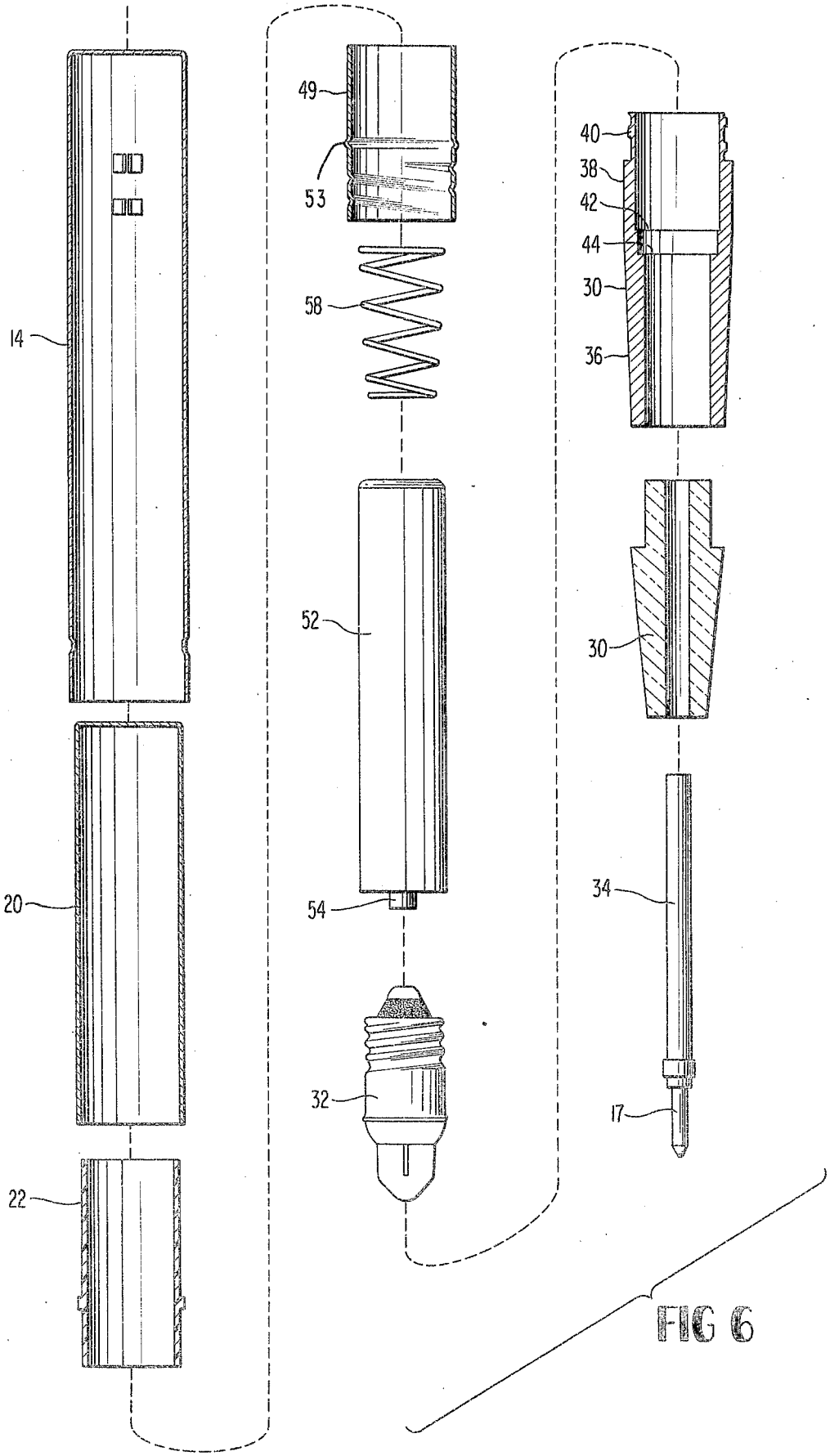
FIG. 6 is an exploded view of the various parts forming the writing implement with self-contained illumination hereof with certain of the parts illustrated in cross section.

Referring particularly to FIGS. 4 and 6, it will be appreciated that barrel 12 is elongated and has first and second tubular sections 18 and 20 formed of an electrically conductive material and axially spaced one from the other. Means are carried by the barrel for electrically insulating sections 18 and 20 one from the other and includes an insulating sleeve 22, the opposite ends of which telescopically receive the near ends of the first and second tubular sections 18 and 20. Thus, insulating sleeve 22 forms a structural part of the barrel 12 structurally interconnecting sections 18 and 20. Sleeve 22 and section 18 and 20 are secured one to the other, for example, by an epoxy. Insulating sleeve 22 includes a radially outwardly projecting annular rim or band which, when sections 18 and 20 are applied about sleeve 22, separates the near ends of sections 18 and 20 from one another and lies flush with the outer surfaces of sections 18 and 20 to form a substantially smooth continuation of those surfaces.

Section 18 includes a lens 26 coaxially carried by the barrel at one end thereof and a writing means, for example the ball point pen 17, which is carried by lens 26 substantially coaxially therewith. Particularly, lens 26 is preferably formed of a clear plastic material which is transmissive to light. From a review of FIGS. 4 and 6, it will be appreciated that lens 26 includes an elongated frustoconical tube or sleeve having a reduced diameter axially projection portion 28 telescopically receivable within the forward end of a tubular housing 30 which carries a lamp 32. Lens 26 is suitably secured to housing 30, for example by an epoxy. Lens 26 also has an axial passage at 31 which receives the stem 34 of the writing means. The writing means is suitably secured within plastic lens 26, for example by a suitable epoxy.

As best illustrated in FIG. 6, housing 30 has a slightly tapered conical end 36 terminating in an intermediate cylindrical section 38, the opposite end of which is reduced in diameter as at 40. Barrel 30 is counterbored to provide a pair of annular shoulders 42 and 44 and is formed of an electrically conductive material. As will be appreciated from a review of FIG. 4, lamp 32 has a contact 46 at its base and a metal jacket 48 in electrical contact with barrel 30 by engagement of jacket 48 with shoulder 42.

Tubular section 18 also includes a sleeve 49 which is internally threaded for connection with the rearward end of housing 30 which end is externally threaded. Since both sleeve 49 and housing 30 are formed of electrically conductive material, it will be appreciated that the lamp is in electrical contact with sleeve 49 through housing 30. It will also be appreciated that the lamp is carried by housing 30 directly coaxially behind lens 26 and in coaxial alignment with the writing means. Further, sleeve 49 has an outwardly projecting annular bead 53 between the internally threaded end and the insulating band 22 to prevent the end of cap 14 from butting the tip of writing means 17 when cap 14 is closed over that end of the barrel as illustrated in FIG. 1.

The opposite end of the second tubular section 20 is closed at 50. From a review of FIG. 4, it will be appreciated that tubular sections 18 and 20 when structurally interconnected by insulating sleeve 22 define a compartment 51 for a battery designated 52. When battery 52 is disposed in compartment 51, the contact terminal 54 projecting at one end of battery 52 lies in electrical contact with contact 46 at the base of lamp 42. Means are carried by the barrel at its opposite end for electrically connecting the other battery terminal 56 with the second tubular section 20 and, in a preferred form hereof, includes a helical electrically conduct spring 58 disposed between terminal 56 and end cap 50.

Referring now particularly to FIG. 6, cap 14 is formed of an electrically conductive material and is closed at one end by an end wall 62. Cap 14 is also provided with a pair of diametrically opposed identations 64 in its opposite sides adjacent to its open end to ensure positive electrical contact with tubular section 18 as described in the ensuing description. Cap 14 has a layer 63 of electrical insulating material for reasons discussed herein. Preferably, the insulating layer 63 is comprised of a layer or coating of lacquer, for example a No. 337 Egyptian epoxy, which is applied about the entire external surface of the cap.

When writing implement 10 is not in use, cap 14 is disposed over the writing end of barrel 12 as illustrated in FIG. 1. Particularly, cap 14 is received about the end of barrel 12 to the extent that the end of cap 14 butts bead 53. A friction fit is provided between the cap and barrel to maintain the cap on the barrel and the implement closed. Since bead 53 is located rearwardly of the insulating band 24, no electrical connection is provided between tubular sections 18 and 20, when the writing implement is closed as illustrated, because band 24 electrically insulates sections 18 and 20 one from the other.

Figure 3:
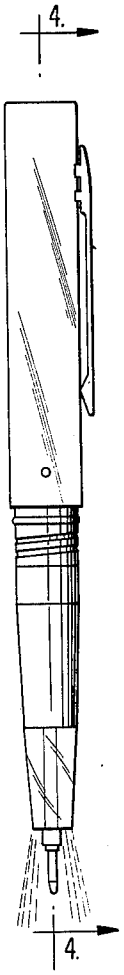
FIG. 3 is a view similar to FIG. 2 illustrating the location of the cap along the barrel when illumination is desired.
Figure 5:
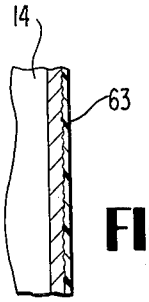
FIG. 5 is a fragmentary enlarged cross-sectional view of a portion of the wall of the cap illustrating the insulating coating thereon.

To use the writing implement, cap 14 is removed from the writing end of the barrel and placed about the opposite end of barrel 12. During the daytime when illumination of the writing surface is not needed or desired, cap 14 is placed about the end of the barrel such that its end remains spaced rearwardly of insulating band 24 leaving the insulating band 24 externally exposed as illustrated in FIG. 2. Consequently, insulating band 24 again serves to prevent completion of the electrical circuit to the lamp. Should illumination be required, however, cap 14 is pressed further onto the barrel such that the end of cap 14 is disposed forwardly of band 24, i.e. between band 24 and bead 53 as illustrated in FIG. 3. Consequently, cap 14, which is formed of electrically conductive material, makes an electrical connection between tubular sections 18 and 20. This completes the circuit to lamp 32. Particularly, the circuit is completed from battery 52 through contacts 54 and 46, lamp 32, housing 30, sleeve 49, cap 14, tubular section 20 and coil spring 58. It will be appreciated that when lamp 32 is energized, light from the lamp is transmitted through lens 26 in a substantially uniform concentric pattern about writing means 17. That is, due to the coaxial arrangement of the lamp, writing means, and lens, the light from the lamp is dispersed substantially equally about the writing means and illuminates the entire area surrounding the writing point 17. To turn the lamp off, cap 14 is withdrawn to the position illustrated in FIG. 2 wherein its open end is located rearwardly of the insulating band 24 or is withdrawn or removed entirely. This breaks the circuit at the juncture of tubular sections 18 and 20.

It will be appreciated that, when cap 14 is replaced about the writing end of the barrel, the external coating or layer 63 serves as an electrical insulator. This effectively prevents electrical contact between the two tubular sections, should, for example, the pen be disposed against a metallic object in the pocket of the individual carrying the pen. Thus, unnecessary and undesirable discharge of the battery is avoided.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. A writing implement with self-contained illumination comprising:

an elongated barrel having first and second tubular sections formed of electrically conductive material and axially spaced one from the other, a lens positioned coaxially with said barrel at one end thereof, writing means carried by said lens substantially coaxially therewith, means carried by said barrel electrically insulating said sections one from the other, means in said barrel defining a compartment for a battery, a lamp carried by said barrel directly coaxially behind said lens and said writing means and in electrical contact with said first tubular section, said lamp having a contact for electrical connection with a terminal of the battery, means carried by said barrel for electrically connecting the other terminal of the battery and said second section, and a cap formed of an electrically conductive material and receivable over the end of the barrel remote from said writing means for retention by said barrel when said writing means is in use, said cap being axially slidable from a first axial position remote from said writing means to a second axial position proximate said writing means for electrically connecting said sections one to the other when illumination is desired and thereby completing an electrical circuit to said lamp.

2. A writing implement according to claim 1 wherein said writing means is solely supported by said lens, said lens concentrically surrounding said writing means to enable transmission of light through said lens substantially concentrically about said writing means.

3. A writing implement according to claim 1 wherein said insulating means includes a tubular member telescopically connected with said first and second sections, said tubular member including a band of insulating material electrically insulating said sections one from the other.

4. A writing implement according to claim 1 wherein said cap has a layer of electrical insulating material about its external surface to prevent inadvertent electrical connection between said first and second sections when said cap is received about the end of the barrel carrying the writing means.

5. A writing implement according to claim 4 wherein said band is located along said barrel a distance from the end of the barrel remote from said writing means at least as great as one-half the length of said cap to enable said cap to be received about and retained on the barrel without making electrical contact with said first section and permitting further axial displacement of said cap along said barrel to enable electrical contact between said cap and said first section.

6. A writing implement according to claim 1 wherein said cap includes an indentation on one side thereof to ensure positive electrical contact with said first section.

7. A writing implement according to claim 1 wherein said lens concentrically surrounds said writing means to enable transmission of light through said lens substantially concentrically about said writing means.

8. A writing implement according to claim 7 wherein said insulating means includes a tubular member telescopically connected with said first and second sections, said tubular member including a band of insulating material electrically insulating said sections one from the other and structurally interconnecting said sections one to the other.

9. A writing implement according to claim 7 wherein said cap has a layer of electrically insulating material about its external surface to prevent inadvertent electrical connection between said first and second sections when said cap is received about the end of the barrel carrying the writing means, said band being located along said barrel a distance from the end of the barrel remote from said writing means at least as great as one-half the length of said cap to enable said cap to be received about and retained on the barrel without making electrical contact with said first section and permitting further axial displacement of said cap along said barrel to enable electrical contact between said cap and said first section.

10. A writing implement according to claim 9 wherein said cap includes an indentation on opposite sides thereof to ensure positive electrical contact with said first section.

11. An improved writing implement of the type having a light bulb positioned coaxially with a writing point to illuminate a writing surface, a battery positioned coaxially with the bulb, one terminal of the battery being in electrical contact with one terminal of the bulb, the improvement comprising:

(a) an insulative sleeve member;

(b) a barrel for enclosing the bulb and battery and for holding the writing point, said barrel having a first conductive part in electrical contact with the other terminal of the bulb and a second conductive part in electrical contact with the other terminal of the battery, said insulative sleeve member engaging and axially spacing said first and second barrel parts; and (c) means for electrically bridging the space between said first and second conductive barrel parts, said means including an axially slidable conductive cap member retained on the end of said barrel opposite the writing point by frictional engagement, said cap member having at least two axial positions relative to the location of the writing point, the proximate position establishing the required electrical connection between said first and second barrel parts through said cap member, said cap member also being removable and receivable over the other end of said barrel for enclosing the writing point when not in use.

12. The improved writing implement as in claim 11 including stop means located on the outside of barrel for determining said cap member proximate axial position, said stop means also for preventing said cap member from electrically bridging said spaced first and second barrel parts when said cap member encloses the writing point.

* * * * *